United States Patent [19]

Krenzer

[11] Patent Number: 4,501,046

[45] Date of Patent: Feb. 26, 1985

[54] METHOD AND APPARATUS FOR PRODUCING SYNTHETIC MULTIFILAMENT YARN

[75] Inventor: Eberhard Krenzer, Ennepetal-Rüggeberg, Fed. Rep. of Germany

[73] Assignee: Barmag Barmer Maschinenfabrik AG, Remscheid, Fed. Rep. of Germany

[21] Appl. No.: 363,846

[22] Filed: Mar. 31, 1982

[30] Foreign Application Priority Data

| | | | |
|---|---|---|---|
| Apr. 1, 1981 | [DE] | Fed. Rep. of Germany | 3113017 |
| Apr. 24, 1981 | [DE] | Fed. Rep. of Germany | 3116304 |
| Jul. 4, 1981 | [DE] | Fed. Rep. of Germany | 3126519 |
| Oct. 17, 1981 | [DE] | Fed. Rep. of Germany | 3141343 |

[51] Int. Cl.[3] ..... D01G 1/08

[52] U.S. Cl. ..... 19/0.35; 57/246

[58] Field of Search ..... 19/0.3, 0.35, 0.39, 19/0.46, 0.37, 0.56, 0.58; 28/271, 273, 283, 244, 245, 281, 240, 219, 217; 57/243, 245, 246

[56] References Cited

U.S. PATENT DOCUMENTS

| | | | |
|---|---|---|---|
| 2,208,497 | 7/1940 | Coleshill et al. | 28/245 X |
| 2,234,540 | 3/1941 | Fryer | 19/0.35 X |
| 2,276,208 | 3/1942 | Kline | 19/0.35 X |
| 2,783,609 | 3/1957 | Breen | 57/140 |
| 2,852,906 | 9/1958 | Breen | 57/246 |
| 3,781,953 | 1/1974 | Stegelman | 28/240 |
| 4,297,837 | 11/1981 | Bauer et al. | 57/337 |
| 4,338,776 | 7/1982 | Krenzer | 28/281 X |

FOREIGN PATENT DOCUMENTS

| | | | |
|---|---|---|---|
| 603368 | 3/1932 | Fed. Rep. of Germany | 28/219 |
| 912618 | 4/1954 | Fed. Rep. of Germany | 19/0.35 |
| 2500093 | 10/1975 | Fed. Rep. of Germany . | |
| 2749867 | 5/1979 | Fed. Rep. of Germany . | |
| 61396 | 7/1912 | Switzerland | 28/219 |

*Primary Examiner*—Louis K. Rimrodt

*Attorney, Agent, or Firm*—Bell, Seltzer, Park & Gibson

[57] ABSTRACT

A method and apparatus is provided for producing a synthetic multifilament yarn having the appearance, bulk and hand characteristics normally associated with spun yarns of staple fibers. The yarn is air jet textured to form loops, coils, bows and the like in the filaments, and at least some of the projecting loops, coils, and bows are enlarged or parted by advancing and looping the yarn around one or more rotating rollers, such that the portion of the yarn running onto the roller overlaps and contacts the portion of the yarn leaving the roller and thereby clampingly engages the projecting loops, coils, bows and the like of the leaving yarn portion. The efficiency of the process may be controlled by varying the number of rollers, as well as the yarn tension during the parting operation.

38 Claims, 16 Drawing Figures

METHOD AND APPARATUS FOR PRODUCING SYNTHETIC MULTIFILAMENT YARN

The present invention relates to a method and apparatus for producing synthetic multifilament yarn which has physical characteristics of appearance, bulk, and hand which are comparable to those of a conventional yarn of staple fibers.

In the production of yarn for various and sundry textile fabrics and other uses, much attention has been given to finding a method by which certain desirable wool-like characteristics of conventional spun yarn, e.g. appearance, bulk, and hand, could be imparted to synthetic, continuous, multifilament yarn. In particular, known processes exist for expanding such synthetic yarn, by which loops, coils, bows, and the like are formed inside the yarn and on the periphery of the yarn core. The loops, coils, bows inside the yarn ensure a greater bulk in the yarn, whereas the yarn is given wool-like characteristics as to its feel and its appearance due to the loops, coils, bows on the periphery of the yarn.

One type of yarn expanding process which is increasingly utilized by the industry is the air jet texturizing method, according to which the yarn is treated by a high velocity air jet. This method is, for example, described in U.S. Pat. Nos. 2,783,609 and 2,852,906, as well as in applicant's copending U.S. application Ser. No. 958,644, filed Nov. 8, 1978, now U.S. Pat. No. 4,338,776, granted July 13, 1982 (which corresponds to German Offenlegungsschrift 27 49 867). In addition, there have previously been efforts to amplify the range of application of those yarns by breaking the loops, coils, bows, and the like present on the periphery of the yarn core, by subjecting the yarn to frictional forces. Such treatments, however, involve the risk of damaging the yarn core. Also, it is difficult to determine the parameters of the procedure exactly enough for high speed production, and to reproduce them. Still further, a decrease in tensile strength of the yarn usually results from the breaking of the loops, coils, bows, and the like.

In accordance with the present invention, the above objects are achieved while avoiding the indicated disadvantages. In particular, the present invention includes the steps of forming loops, coils, bows and the like in the filaments of an advancing multifilament yarn, preferably by advancing the yarn through a high velocity air jet texturizing device. At least some of the loops, coils, bows, and the like are then enlarged by advancing the yarn around at least one rotating roller and such that the portion of the yarn running onto the roller overlaps and contacts the portion of the yarn leaving the roller and thereby clampingly engages the projecting loops, coils, bows and the like of the leaving yarn portion.

With the present invention, there is no major decrease in tensile strength of the yarn, and there may in fact be an increase, depending upon the particular parameters of the employed method. Typically, some of the loops, coils, bows and the like are enlarged, while others are parted or broken. Thus the term "enlarged" as used herein is intended to encompass the expansion of some or all of the loops, coil, bows, and the like, as well as the parting or breaking of some or all thereof.

The run-off properties of the yarn, when running off their spools, are substantially improved with the present invention, and the "burr effect", i.e. the tendency of woven or knitted goods produced from air jet texturized yarns to adhere to each other, is considerably reduced. The range of application of air jet texturized yarns is greatly increased, especially, when combining the treatment of the yarn according to the invention with a mechanical stabilization of the yarn and, specifically, when combining it with the process described in the German Offenlegungsschrift 27 49 867. The efficiency of the process, viz. the extent of the enlargement of the loops, coils, bows, and the like which are formed by the air jet texturization of the yarn, can be influenced within a wide range and in a delicate manner by varying the number of the rollers located within the thread path and looped by the yarn.

The efficiency of the process can also be influenced and varied by controlling the tension of the yarn. In this connection, it should be noted that the yarn tension increases in the direction of the yarn path, however, in total it decreases, if the rollers are freely rotatable. In order to obtain a sufficient tension of the yarn at the very beginning of the yarn treatment according to the invention, it is proposed to drive at least the first roller. It is, however, possible and advantageous for all of the rollers be driven at an increasing speed in the direction of the yarn advance, with one of the rollers serving as an entry yarn feed means, or an exit yarn feed means of the treating zone.

It has been found that a desired texturizing result can be achieved within a large range of application, by selecting the number of the looped, freely rotatable rollers and by the correct adjustment of the tension of the yarn. Enlargement of the loops, coils, bows, and the like according to the present invention involves, on the one hand, breaking the fibers in the region of the loops, coils, bows. On the other hand, the texturizing effect according to this invention may also involve pulling the filaments which form loops, coils, bows, and the like further out of the yarn core. These filaments which form loops, coils, bows, and the like can be broken by a special treatment, e.g. by singeing or mechanical shearing or breaking, in order to modify the texturizing effect and, above all, to shorten the fibers projecting from the yarn core.

A further possibility to influence the efficiency of the process according to the invention is to modify the inclination of the rollers to the yarn path. It should, however, be noted that the axes of the rollers are preferably located substantially perpendicular to the yarn path.

A particular object within the framework of the present invention is to ensure a smooth run of the yarn, in order to avoid irregularities of the yarn. It has been found that this object can be achieved by utilizing conical rollers. In order to ensure a good contact between the yarn and the rollers, there may be used rollers having an increasing angle of cone, preferably in the form of two successive conical sections. The stability of the yarn run is furthered also by the fact that the yarn running onto the rollers is supported by a steep, preferably conical collar.

It has also been found that it is possible to utilize cylindrical rollers. For increasing the stability of the yarn run, these cylindrical rollers should preferably be displaced axially so that the yarn segment which leaves a roller runs against the supporting collar of the following roller.

The invention in particular results in the production of multifilament yarn, the smooth, unbroken filaments of which having good strength properties particularly with regard to tensile strength, elasticity and elongation at break, whereas the enlarged filaments, i.e. the filaments forming the characteristics of a fiber yarn, produce very favorable textile properties.

In accordance with one specific embodiment of the invention, several thread components consisting particularly of different materials may be plied together before being subjected to the air jet texturization. In such case, the air jet texturization process can be controlled in such a manner that the loops, coils, bows, and the like are formed essentially in the thread component having the more advantageous textile properties. This may be achieved, if such thread component is guided under low tension through, or supplied with overfeed to, the air jet texturizing zone, or if such thread component has a greater elasticity or extensibility. In these cases, it is only this thread component which forms loops, coils, bows, and the like, which project from the periphery of the yarn and which are enlarged under the subsequent treatment according to the present invention. Also, it is not necessary that both thread components consist of a fully synthetic material. Thus in particular, the smooth, i.e. unbroken thread component, may consist of a semi-synthetic material, as for example rayon.

It should be noted that the method according to the present invention is also applicable to yarns which consist solely of rayon or glass fibers, or solely of continuous synthetic filaments. The use of various components is advantageous particularly for the preparation of special yarn properties. With regard to fiber yarns, it is desirable to attain a low tendency to pilling. For this reason, the thread component forming the loops, coils, bows, and the like should have a low tendency to pilling (note German Auslegeschrift 23 08 31). It should, however, be stressed that the method of the present invention provides a significant decrease in the tendency of the yarns to pilling, which may be attributed to the fact that, particularly when combining it with the mechanical stabilization and a successive thermal treatment, the fiber ends are tightly entangled in the filaments.

It has been found that fiber yarns of polypropylene have very good textile wearing properties, by reason of their ability to absorb moisture. On the other hand, continuous threads of polypropylene have significant disadvantages. The process according to the present invention permits the production of a combined yarn in which the continuous filaments which do not break are of a material other than polypropylene, and in which the broken filaments are of polypropylene.

Another possibility for modifying the characteristics of the fiber yarn is to use components which show differing tendencies to shrinking, or to use components which have a differing total linear density, or a differing linear density of their filaments.

The process of the present invention may be incorporated in a continuous process according to which continuous yarns are subjected to an air jet texturization, then treated in accordance with the present invention, and then wound into a package. There is one air jet texturizing method preferred, according to which the yarn, after being air jet texturized, is stabilized by placing it under a tension which lies within the range of its elastic deformation limit. At the same time, or immediately after having left such a stabilizing zone, the yarn is treated according to the present invention, and finally wound into a package. When incorporating the inventive treatment in the air jet texturizing method as described in the German Offenlegungsschrift 27 49 867, i.e. in the mechanical stabilizing process which is provided by that known method, a yarn is obtained which has optimal properties. By these combined treatments, a yarn is produced which has loops, bows, coils, and fiber ends which are tightly bound in and project from the yarn core. The optimal temperatures in the heating zone are dependent particularly on the length of the heating zone, the speed of the yarn, the linear density of the yarn, and the material of the yarn. Here, the nominal temperature for polypropylene ranges from 150° to 160° C. It is stressed in this connection that the yarn does not reach this temperature due to its high running speed and to a delayed heat transmission. The temperature which the yarn reaches is considerably lower than the temperature of the heating device, which device is preferably based on the convection and radiation principles.

The strengthening of the yarn to a still higher degree, which is realized by the heat treatment, leads to a special result with regard to strength properties and texturizing effect. It is by this combination that the "burr effect", which appears in knitted fabrics of air jet texturized yarns, can be essentially overcome. Thus, other fields of application, in particular the field of circular knitting, will be accessible to air jet texturized yarns.

The invention, furthermore, provides special measures to achieve looping angles which exceed 360° about the rollers, and which preferably are adjustable. It is, moreover, possible and advantageous for achieving special texturizing effects to equip one or several rollers with a friction coating, so that the yarn surface is roughened, and in particular some of the loops, coils, bows, and the like are broken by this roughening.

Some of the objects of the invention having been stated, other objects and advantages will appear as the description proceeds, when taken in connection with the accompanying schematic drawings, in which FIG. 1 is a schematic side elevation view illustrating the method and apparatus of the present invention;

FIG. 1*a* is a fragmentary enlarged side elevation view of the operative portion of one of the rollers;

Figure 3:
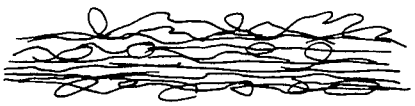
FIG. 3 is an enlarged view of a segment of a bulked, continuous filament yarn which is characterized by loops, coils, bows and the like formed in the filaments thereof by a conventional air jet texturizing process.
Figure 4B:
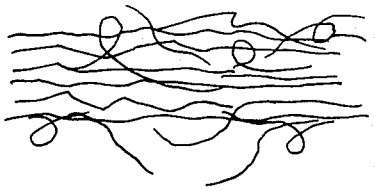
Figure 4A:
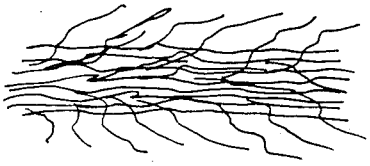

FIGS. 4*a* and 4*b* show the yarn of FIG. 3 which has been processed in accordance with the present invention, with the degree of filament breakage being greater in FIG. 4*a;*

Figure 5:
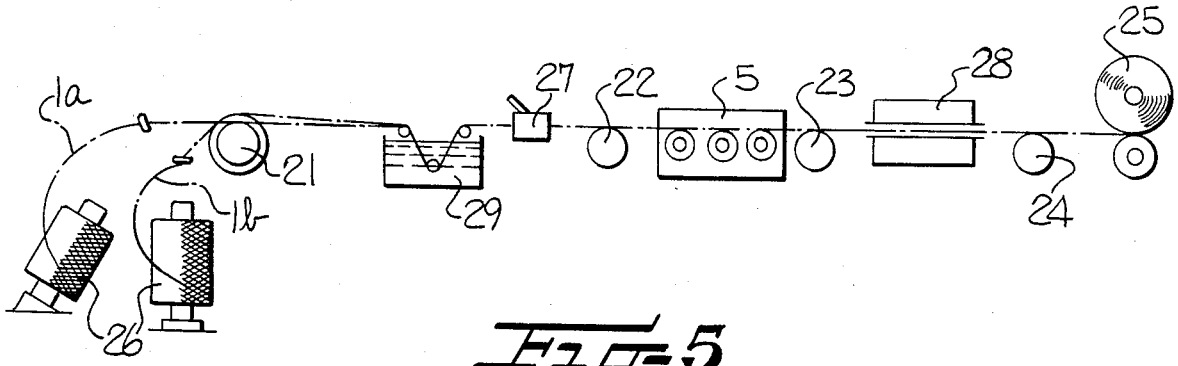
Figure 6:
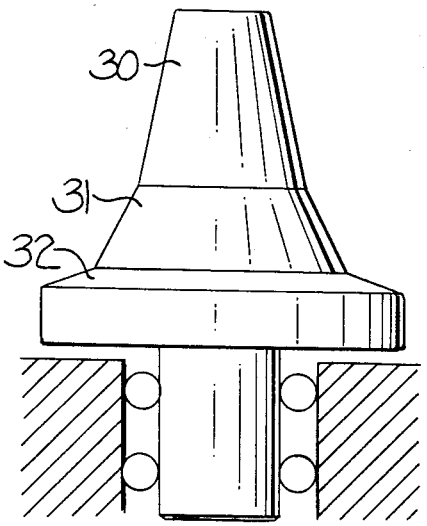
Figure 7:
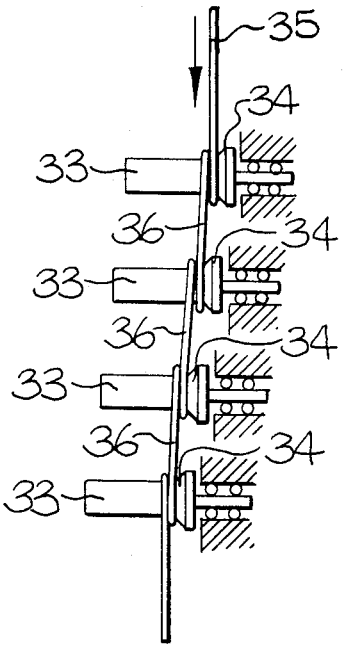
Figure 9:
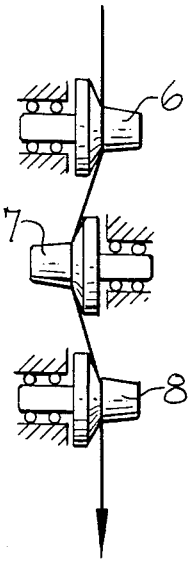
Figure 10A:
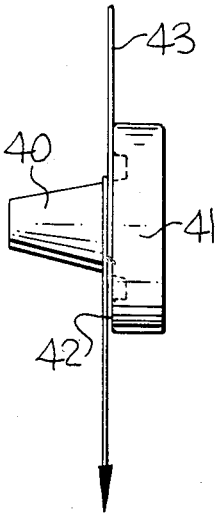
Figure 10B:
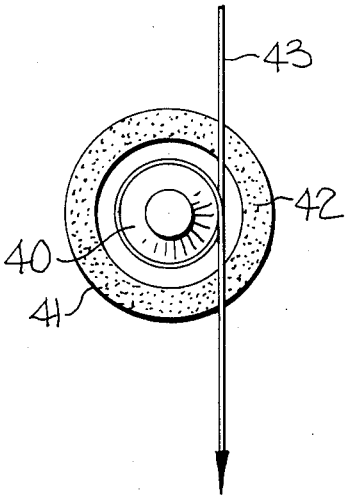

FIG. 5 is a schematic side elevation view of an alternative embodiment of a method and apparatus according to the present invention;

FIG. 6 is a side elevation view of a roller which may be utilized with the present invention;

FIG. 7 is a side elevation view of a plurality of cylindrical rollers which may be utilized with the present invention;

FIGS. 8*a*, 8*b*, 8*c* and 8*d* are schematic plan views illustrating differing roller arrangements, as well as differing arrangements for adjusting the yarn looping angle;

FIG. 9 is a side elevation view of a plurality of conical rollers which may be utilized with the present invention; and FIGS. 10*a* and 10*b* are side elevation and plan views respectively, of still another embodiment of a roller which may be utilized with the present invention.

Figure 1:
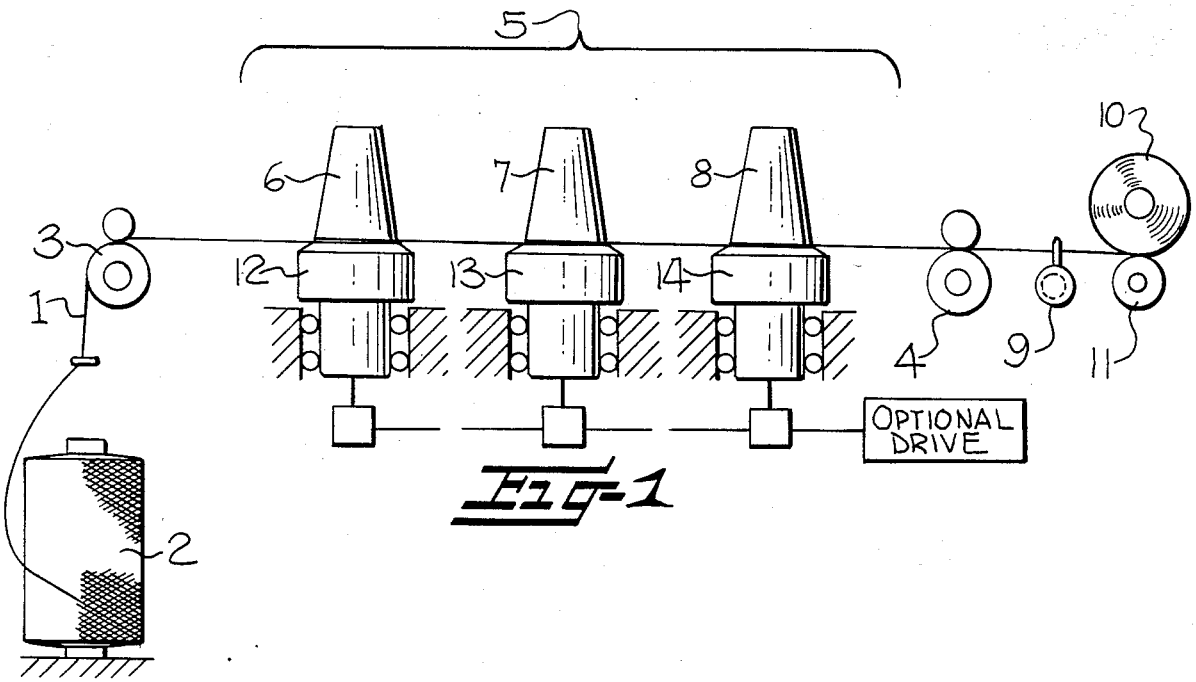

Referring more particularly to the drawings, FIG. 1 illustrates a method and apparatus wherein a yarn 1 is withdrawn by the yarn feed means 3 from the delivery package 2. By the delivery means 4, the yarn is conveyed under tension through the treating zone 5. The package 2 carries a bulked yarn whose general appearance is illustrated schematically in FIG. 3, a salient feature of which includes the loops, coils, and bows which project from the yarn periphery. In the treating zone 5, the yarn is looped around the freely rotatable rollers 6, 7, 8 with one turn of 360° each. Reference numeral 9 indicates a traverse motion device, 10 a take-up package, and 11 a drive roller to drive the take-up package 10. The rollers 6, 7, and 8 are supported in cantilever fashion, and have a collar 12, 13, 14 respectively. In a modified embodiment, one or more of the rollers may be driven in the manner indicated schematically in FIG. 1.

Figure 1A:
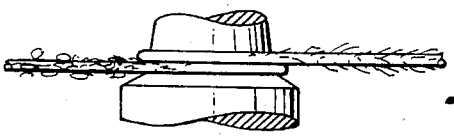
Figure 2:
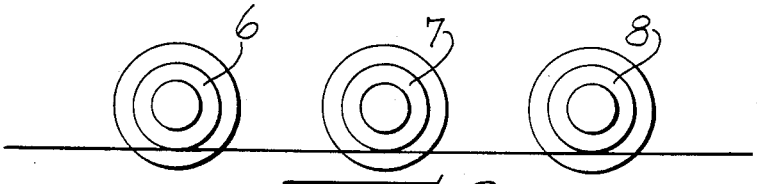
FIG. 2 is a top plan view of the three rollers shown in FIG. 1.

The yarn is looped around the rollers in such a manner that it moves toward the collar. For resisting this movement, the rollers have been provided with a slightly conical shape. FIG. 1*a* shows a yarn, one segment of which is running onto the roller, and the other segment leaving the roller. It should be noted that the yarn need not contact the entire circumference of the rollers and it is possible to utilize deflection rolls which are each associated with one of these rollers and which are inclined or parallel to the axes of the rollers. An important feature of the invention is that the yarn segment running onto each of the rollers 6, 7, 8 overlaps the leaving segment, at least its circumference, thus clamping on the rollers the loops, coils, bows, and the like which project from the periphery of the leaving yarn segment. Thus, the clamped loops, coils, bows and the like are enlarged. The treating zone 5 may comprise more than three rollers and the yarn may loop around any number of such rollers. It is thus possiole to vary the extent of the enlargement.

FIG. 5 schematically illustrates an embodiment of the present invention and which is incorporated in a process as described in the German Offenlegungsschrift 27 49 867. More particularly, there is provided a stabilizing zone 5 between the thread feed means 22 and 23, wherein the yarn is subjected to the treatment of the present invention after being texturized in the texturizing device 27. Yarn feeding means 21 withdraws two thread components 1*a* and 1*b* from separate yarn packages 26, and delivers the two components into the air jet texturing zone. Located within the air jet texturing zone is a yarn bath 29, whereby the components are suitably moistened. The air jet texturing device 27, which is of known design, is positioned downstream of the bath 29. During its passage through the air jet texturing device 27, the continuous filaments of the thread components 1*a* and 1*b* are bulked by the action of the high velocity air, and the individual filaments have loops, bows, coils, and the like formed therein, in the manner schematically illustrated in FIG. 3. Downstream of the stabilization zone 5, there is provided a suitable heating means 28 for increasing the temperature of the filaments of the yarn to that point required to heat set the yarn. As is well known, such heat setting also results in a limited shrinkage of the yarn. From the heating means 28, the yarn is advanced by the feed means 24 to the package 25. As to further details of the overall process, reference is made to the above identified Offenlegungsschrift.

To achieve different delivery speeds for the thread components 1*a* and 1*b*, the yarn feed means 21 may, for example, be designed as a stepped roller. Due to the different diameters of the steps of the roller, the thread components run at different speeds. As illustrated, the thread component 1*a* is guided over the step having a smaller diameter and is placed under a higher tension in the air jet texturizing zone than is the other component 1*b*. In the air jet texturizing zone, the thread component 1*a*, being under higher tension, receives fewer loops, coils, bows, and the like as compared to the overfed component 1*b*. The component which has been overfed to a greater degree should, therefore, have those properties which form the characteristics of a fiber yarn. This component may, for example, be a continuous polypropylene yarn, which when subjected to the treatment according to the present invention, breaks like a staple fiber.

In one experiment, a polyester yarn dtex 167 f 68 double=334 dtex was air jet texturized and treated and wound up as described in the German Offenlegungsschrift 27 49 867. The resulting yarn had a linear density of 390 dtex and a tensile strength of 2.06 cN/dtex. The yarn was bulky with a plurality of loops, coils, bows, and the like projecting from its surface. This yarn was then subjected to the treatment according to the present invention, being supplied to five rollers under a tension of 25 cN. Thereupon, the yarn had a plurality of open fiber ends projecting from the yarn core, and its tensile strength was 2.4 cN/dtex.

In a parallel experiment, an air jet texturized yarn which after being air jet texturized was stabilized but not heat set, was treated in accordance with the present invention. The tensile strength of this yarn which looped around five rollers increased from 2.36 cN/dtex to 2.8 cN/dtex. The same values were obtained in the continuous procedures according to FIG. 5, in which the treating zone 5 was arranged in the stabilizing zone between the thread feed means 22 and 23.

FIG. 4*a* shows a yarn treated in conformity with the present invention with broken fiber ends projecting from the yarn core. It should be noted that by the enlargement of the loops, coils, bows, and the like projecting from the yarn surface, which enlargement also can be realized by this invention, a desirable texturizing effect can be achieved.

FIG. 4*b* shows a yarn which has been treated according to the present invention with only part of its loops and bows being broken. By varying the number of rollers which are looped by the yarn and, moreover, by varying the yarn tension applied, the texturing results achieved in the range between the type of yarn according to FIG. 4*a* and the one according to FIG. 5*b*, can be substantially controlled.

FIG. 6 shows a small, freely rotatable roller which could be utilized instead of the roller 6 and/or 7 and/or 8 in FIG. 1. This roller includes a take-up cone 30, a working cone 31 with a greater cone angle, and a supporting cone 32 or collar with a still greater cone angle. It has been found that in the region of the collar, the diameter of the cone should preferably be at least 8 mm. Otherwise, the texturing result or the smooth run of the thread or its operability may be impaired.

FIG. 7 shows cylindrical rollers 33 each with a supporting collar 34, which can also take the place of rolls 6, 7, 8 in FIG. 1. With respect to the stabilization of the run of the yarn 35, it is preferable that the rollers be axially displaced in a direction toward the yarn path, so that the yarn segment 36 which has left the first roller 33 runs against the supporting collar of the following roller and so forth. It should be noted that, especially when utilizing cylindrical rollers, the stability of the yarn run can also be increased by staggering the rollers so as not to be exactly parallel, and in such a way that the free ends of the rolls are inclined to each other by a few degrees.

Figure 8A:
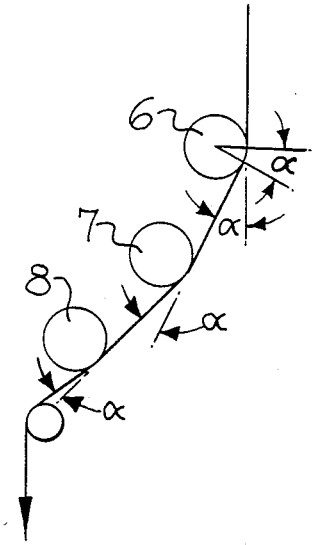

In FIGS. 8*a* to 8*d*, there are shown a number of possibilities for controlling the yarn looping angle. In this connection, it should be emphasized again that the looping angle should in any case be at least about 360°, and it might exceed 360°. In FIG. 8*a* the rollers 6, 7, 8 are located on a curved path in plan. Thus, the looping angle is increased beyond 360° by the angle alpha at each roller.

Figure 8B:
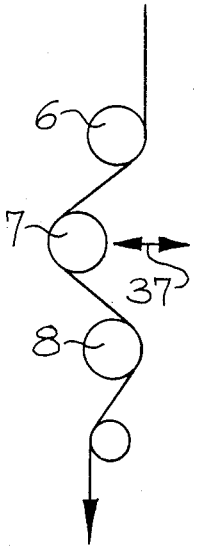
Figure 8C:
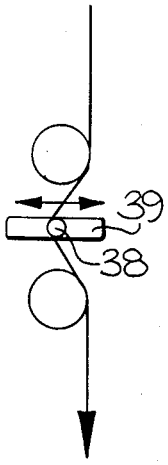
Figure 8D:
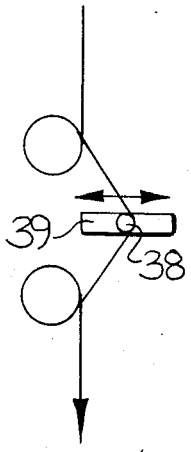

In FIG. 8*b*, the rollers are arranged in a zig-zag manner in plan, i.e. the rollers are displaced relative to each other in two rows. The looping angle may thereby be increased. An increase in the looping angle to more than 360° can also be achieved by the variation of the looping direction from roll to roll. Thus, the looping angle can be set by displacing the roller 7 in the direction of the arrow 37. FIGS. 8*c* and 8*d* show a yarn guide 38 which has the form of a pin which is movable along a guideway 39. This yarn guide also serves to control the looping angle. If the yarn guide is positioned as shown in FIG. 8*c*, the looping angle may be significantly varied and with the yarn guide positioned as shown in FIG. 8*d*, the looping angle may be varied to a lesser degree.

FIG. 9 shows an arrangement of the rollers 6, 7, 8 which ensures an increased contact between the yarn segment running onto and the segment leaving the rollers. The axes of the rollers are positioned in a common plane, however, the rollers are oriented to face in opposite directions.

FIGS. 10*a* and 10*b* are side elevation and top plan views of a roller which has a friction surface. Such a roller is preferably applied as the first roller in the yarn path, but it may however replace one or more of the following rollers. As illustrated the roller comprises a conical part 40 and a collar 41. This collar has a roughened rim or friction coating, which lies on a planar surface 42 which is perpendicular to its axis. The yarn 43 running onto the roller passes over this roughened surface 42, and is thus roughened. By this relative movement between the yarn and the surface 42, the texturizing effect can be modified in dependence on the yarn tension and the extent to which the surface is roughened. In particular, it is possible to break only some of the loops, coils, bow, and the like.

Regarding the method as illustrated in FIG. 5, it should be noted that applying the treatment of the present invention within the stabilizing zone will lead to optimum results regarding stability and burr effect, even if the tension applied to the yarn is less than it would have to be in accordance with my copending application, Ser. No. 958,644, without such treatment.

In the drawings and specification, there has been set forth a preferred embodiment of the invention, and although specific terms are employed, they are used in a generic and descriptive sense only and not for purposes of limitation.

That which is claimed is:

1. A method of producing a synthetic yarn having certain physical characteristics, such as appearance, bulk, and hand, which are normally associated with those of conventional yarn formed of staple fibers, and comprising the steps of advancing a continuous multifilament yarn having loops, coils, bows and the like formed in the filaments thereof along a path of travel, while enlarging at least some of the loops, coils, bows and the like in the advancing yarn by guiding the advancing yarn onto and around at least one rotating roller such that the portion of the yarn running onto the roller contacts the portion of the yarn leaving the roller and clampingly engages the projecting loops, coils, bows and the like of the leaving yarn portion.

2. The method as defined in claim 1 including the further step of maintaining the advancing yarn under tension during the enlarging step.

3. The method as defined in claim 1 or 2 including the further step of subjecting a synthetic continuous multifilament yarn to a high velocity air jet to form the loops, coils, bows and the like in the filaments of the advancing yarn.

4. The method as defined in claim 3 wherein the advancing yarn comprises a plurality of individual thread components which are plied together prior to being subjected to the high velocity air jet.

5. The method as defined in claim 4 wherein at least two of the individual thread components are advanced at different speeds while being subjected to the high velocity air jet.

6. The method as defined in claim 4 wherein at least two of the individual thread components have different elasticities.

7. The method as defined in claim 4 wherein at least one of the individual thread components is composed of polypropylene.

8. The method as defined in claim 4 wherein at least two of the individual thread components have different total linear densities.

9. The method as defined in claim 4 wherein at least two of the individual thread components have different linear densities of their individual filaments.

10. The method as defined in claim 1 or 2 comprising the further step of controlling the extent to which the loops, coils, bows and the like are enlarged during the enlarging step by selecting the number of rollers about which the advancing yarn is guided within a range of between 1 to 5 rollers.

11. The method as defined in claim 10 wherein the controlling step further includes selectively controlling the tension in the advancing yarn during the enlarging step.

12. The method as defined in claim 1 or 2 wherein the enlarging step includes parting at least some of the loops, coils, bows and the like in the advancing yarn.

13. A method of producing a synthetic yarn having certain physical characteristics, such as appearance, bulk, and hand, which are normally associated with those of conventional yarn formed of staple fibers, and comprising the steps of advancing a continuous multifilament yarn along a path of travel, feeding the advancing yarn through a high velocity air jet to form loops, coils, bows and the like in the filaments thereof, stabilizing the advancing yarn subsequent to its being sujected to the air jet, by tensioning the yarn within the range of its elastic limit, and enlarging at least some of the loops, coils, bows and the like in the advancing yarn while it is maintained under such stabilizing tension by guiding the advancing yarn onto and around at least one rotating roller such that the portion of the yarn running onto the roller contacts a portion of the yarn leaving the roller and clampingly engages the projecting loops, coils, bows and the like of the leaving yarn portion, and thereafter winding the advancing yarn into a package.

14. The method as defined in claim 13 including the further step of heat treating the advancing yarn subsequent to the enlarging step, to result in a limited shrinkage of the yarn.

15. The method as defined in claim 13 or 14 wherein the enlarging step includes guiding the advancing yarn around at least two rotating rollers in series, with the axes of such rollers lying perpendicular to the yarn path of travel and the surfaces of the rollers being tangent to the yarn path of travel.

16. The method as defined in claim 15 wherein at least the initial roller is rotatingly driven to maintain a desired tension in the advancing yarn.

17. A synthetic continuous multifilament yarn having certain physical characteristics, such as appearance, bulk, and hand, which are normally associated with those of conventional yarn formed of staple fibers, and produced in accordance with the method of either of claims 1 or 13.

18. The method as defined in claim 13 wherein the step of stabilizing the advancing yarn includes contacting the advancing yarn with yarn feeding means both upstream and downstream of a stabilizing zone, and controlling the relative speed of the upstream and downstream yarn feeding means to provide a desired tension in the advancing yarn therebetween.

19. The method as defined in claim 13 wherein the enlarging step includes parting at least some of the loops, coils, bows and the like in the advancing yarn.

20. An apparatus for producing a synthetic yarn having certain physical characteristics, such as appearance, bulk, and hand, which are normally associated with those of conventional yarn of staple fibers, said apparatus comprising the combination with a continuous multifilament yarn, means for advancing a continuous multifilament yarn along a predetermined path of travel, means disposed along the path of travel of the yarn for forming loops, coils, bows and the like in the filaments of the advancing yarn, and enlarging means including at least one rotatable roller disposed along the path of travel of the yarn and cooperating with said advancing yarn for enlarging at least some of the loops, coils, bows and the like formed in the advancing yarn, said advancing yarn being looped around said roller, with the looped yarn having a portion running onto the roller and a portion running away from and leaving the roller, said yarn being so looped around the roller that the portion of the yarn running onto the roller contacts the portion of the yarn leaving the roller and clampingly engages the projecting loops, coils, bows and the like of the leaving yarn portion to effect and impart physical characteristics to the continuous filament yarn which are normally associated with yarns formed of staple fibers.

21. The apparatus as defined in claim 20 wherein each of said rollers is supported in cantilever fashion, with the operative surface thereof being cone shaped so as to converge toward its free end.

22. The apparatus as defined in claim 21 wherein the operative surface of each roller is composed of two truncated cone segments which diverge from the free end thereof.

23. The apparatus as defined in any one of claims 21 or 22 wherein the rollers have an operative diameter greater than about eight mm.

24. The apparatus as defined in claim 20 wherein said enlarging means comprises at least two cylindrical rollers rotatably mounted about parallel axes, with each roller including a conical collar at one end, and with the rollers being axially offset so that the collars project into the yarn path of travel.

25. The apparatus as defined in claim 20 wherein said enlarging means includes at least two rollers rotatably mounted about parallel axes, with each roller including a collar at one end, and with the rollers being mounted such that the advancing yarn is directed into contact with the collar of each roller.

26. The apparatus as defined in claim 25 wherein the collar of each roller is in the form of a truncated cone.

27. The apparatus as defined in claim 25 wherein the collar of each roller defines a flat surface lying in a plane substantially perpendicular to its axis of rotation, and with said flat surface being roughened.

28. The apparatus as defined in claim 20 wherein said enlarging means includes at least three rollers rotatably mounted about parallel axes, with said axes being nonlinear viewed in plan, so that the looping angle of the advancing yarn about each roller may exceed 360°.

29. The apparatus as defined in claim 28 further comprising means for adjustably moving at least one of said rollers in a direction perpendicular to its axis of rotation to thereby permit control of the looping angle of the advancing yarn about the rollers.

30. The apparatus as defined in claim 20 wherein said enlarging means includes at least two rollers rotatably mounted about parallel axes, and further includes a yarn guide mounted intermediate two of said rollers, and means movably mounting said yarn guide for movement in a lateral direction with respect to the yarn path of travel to thereby permit control of the looping angle of the advancing yarn about each of said rollers.

31. The apparatus as defined in claim 20 wherein said enlarging means comprises at least two rollers rotatably mounted about parallel axes, with each roller having a conical collar at one end, and with the rollers being oriented to face in opposite directions and such that the yarn segment leaving a roller is laterally deflected from the direction of the yarn segment supplied to the roller.

32. The apparatus as defined in claim 20 further comprising yarn feeding means disposed immediately upstream and downstream of said enlarging means, and means for controlling the feeding means to impart a desired tension in the yarn advancing therebetween.

33. The apparatus as defined in claim 20 or 32 wherein said enlarging means further includes means for rotatably driving at least one of said rollers.

34. The appararus as defined in claim 33 further comprising means for rotatably driving each of said rollers at speeds which respectively increase in the direction of the yarn path of travel.

35. The apparatus as defined in claim 20 wherein said means disposed along said path of travel for forming the loops, coils, bows and the like in the filaments of the advancing yarn comprises air jet texturizing means.

36. The apparatus as defined in claim 35 wherein said enlarging means further comprises means for controlling the tension of the advancing yarn during enlarging of the loops, coils, bows and the like, and said apparatus further comprises yarn heating means disposed immediately downstream of said enlarging means.

37. The apparatus as defined in claim 20 wherein said enlarging means comprises at least two rollers freely rotatably mounted about parallel axes, wherein each of said rollers is supported in cantilever fashion with the operative surface thereof being cone-shaped so as to converge towards its free end, and with each roller including a collar at the other end.

38. An apparatus for producing a synthetic yarn having certain physical characteristics, such as appearance, bulk, and hand, which are normally associated with those of conventional yarn of staple fibers, said apparatus comprising the combination with a continuous multifilament yarn having loops, coils, bows and the like in the filaments thereof, means for advancing said continuous multifilament yarn along a predetermined path of travel, enlarging means including at least one rotatable roller disposed along the path of travel of the yarn and cooperating with said advancing yarn for enlarging at least some of the loops, coils, bows and the like formed in the advancing yarn, said advancing yarn being looped around said roller, with the looped yarn having a portion running onto the roller and a portion running away from and leaving the roller, said yarn being so looped around the roller that the portion of the yarn running onto the roller contacts the portion of the yarn leaving the roller and clampingly engages the projecting loops, coils, bows and the like of the leaving yarn portion to effect and impart physical characteristics to the continuous filament yarn which are normally associated with yarns formed of staple fibers.

* * * * *